US005078406A

United States Patent [19]

Luttrell et al.

[11] Patent Number: 5,078,406

[45] Date of Patent: Jan. 7, 1992

[54] AERIAL GUNNERY TARGET

[75] Inventors: Clyde K. Luttrell, New Market; Donald T. Moore, Huntsville, both of Ala.

[73] Assignee: Teledyne Industries, Inc., Los Angeles, Calif.

[21] Appl. No.: 536,112

[22] Filed: Jun. 8, 1990

Related U.S. Application Data

[63] Continuation-in-part of Ser. No. 343,438, Apr. 26, 1989, Pat. No. 5,026,073, and a continuation-in-part of PCT/US90/02241, Apr. 25, 1990.

[51] Int. Cl.[5] ..... F41J 9/10

[52] U.S. Cl. ..... 273/360; 244/1 TD

[58] Field of Search ..... 273/360, 361

[56] References Cited

U.S. PATENT DOCUMENTS

| | | |
|---|---|---|
| 1,860,982 | 5/1932 | Binnie . |
| 2,216,776 | 10/1940 | Hoffman . |
| 2,238,875 | 4/1941 | Manson . |
| 2,238,876 | 4/1941 | Manson . |
| 2,243,618 | 5/1941 | Brown . |
| 2,261,171 | 11/1941 | Manson et al. . |
| 2,270,884 | 1/1942 | Manson . |
| 2,342,651 | 2/1944 | Dircksen . |
| 2,402,156 | 6/1946 | Griesinger . |
| 2,419,549 | 4/1947 | Griesinger et al. . |
| 2,807,287 | 9/1957 | Frey . |
| 2,907,095 | 10/1959 | Frey . |
| 2,941,765 | 6/1960 | Feldman . |
| 4,205,848 | 6/1980 | Smith et al. . |
| 4,624,648 | 11/1986 | Waters . |
| 5,026,073 | 6/1991 | Luttrell et al. ..... 273/360 |

FOREIGN PATENT DOCUMENTS

| | | |
|---|---|---|
| 523054 | 10/1953 | Belgium . |
| 0124785 | 4/1984 | European Pat. Off. . |
| 3005611 | 8/1981 | Fed. Rep. of Germany . |
| 496230 | 7/1919 | France . |
| 783489 | 7/1935 | France . |
| 7500687-4 | 9/1976 | Sweden . |
| 2034267 | 6/1980 | United Kingdom . |

*Primary Examiner*—William H. Grieb

*Attorney, Agent, or Firm*—Beveridge, DeGrandi & Weilacher

[57] ABSTRACT

An aerial gunnery target which is towed behind a towing aircraft. The gunnery target includes an extension device that separates a forebody assembly from a visual augmenter. The target also includes a vented inflator positioned at the forward end of the visual augmenter. The vented inflator maintains the front end of the visual augmenter open during towing. The visual augmenter is generally cylindrical in shape with an open aft end and an adjustment device for varying the size of the aft opening. In addition, the visual body is comprised of a mesh netting which preferably includes a plurality of interconnected strands joined together to form a plurality of diamond shaped openings. The inter-connected strands are each formed of a plurality of knitted threads and the strands are preferably joined together by knitting some or all of threads of one strand with some or all of the threads of an interconnecting strand.

9 Claims, 18 Drawing Sheets

FIG. 19
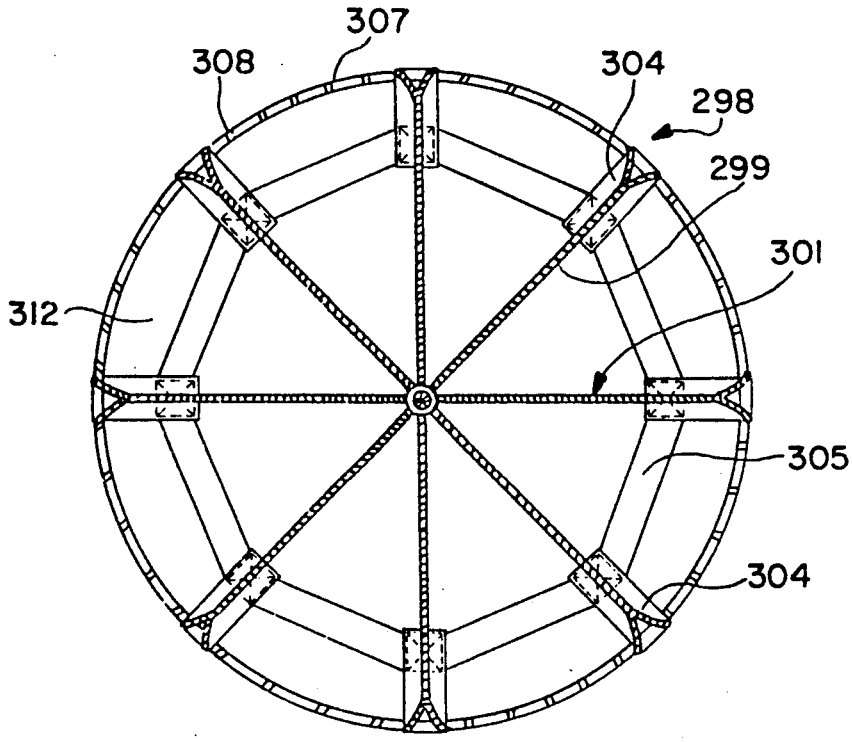
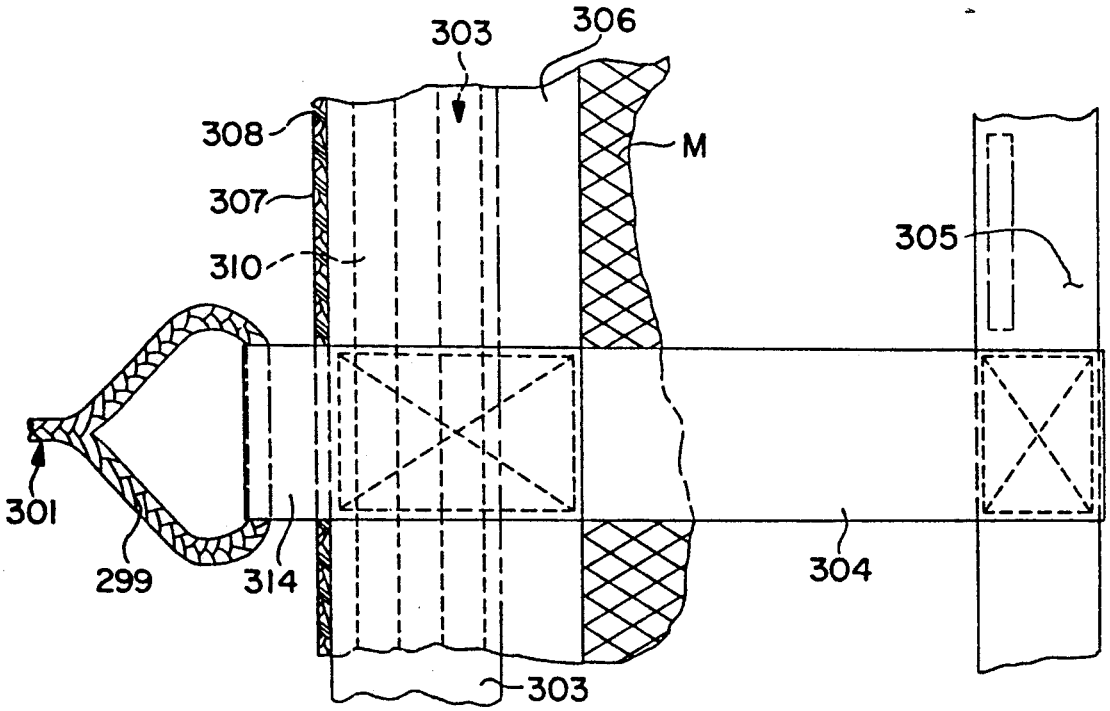
FIG. 20

AERIAL GUNNERY TARGET

RELATED APPLICATION(S)

This application is a continuation-in-part of U.S. application Ser. No. 07/343,438, filed Apr. 26, 1989, now U.S. Pat. No. 5,026,073, granted June 25, 1991. The present application is also a continuation-in-part of International Application PCT/US90/02241 filed Apr. 25, 1990.

FIELD OF THE INVENTION

The field of this invention lies within the target and gunnery art. In particular, it lies within the specific field of aerial targets that are towed behind an aircraft.

DESCRIPTION OF THE RELATED ART

To improve the shooting and pursuit skills of aircraft pilots, various types of targets have been developed which are towed behind a towing aircraft. Some of the earlier target constructions included elongated fabric panels or banners such as those disclosed in U.S. Pat. Nos. 2,731,046 and 2,807,287. These targets included woven panels attached to a bridle assembly which, in turn, was attached to a long cable secured to a towing aircraft. Alternate prior art forms of tow targets include those found in U.S. Pat. Nos. 2,342,651 and 3,000,634 which feature one or more cylindrical sleeves being dragged behind a tow aircraft. Such targets have proven to be susceptible to flagging and oscillation when dragged at high speeds.

U.S. Pat. No. 4,205,848 discloses a banner proposed for use as an aerial gunnery target which includes a plurality of single strands extending between forward and aft frame structures. This type of prior art target is described as avoiding the prior art problems of flagging and oscillating at high speeds due to the elimination of transmitted forces between the individual strands extending along the length of the target.

Nonetheless, single strands also tend to whip and flag and snap in a manner similar to a whip cracking. This whipping action tends to break the ends of the strands thus shortening the length of the augmenter. Also, the use of individualized strands creates a problem of target survivability after repeated hits by the pursuing plane. Once the individualized strands are hit they tend to freely flow about thus degrading the visual acuity of the target and its performance. Moreover, the positioning of the radar or scoring device close to the forward end of the target makes the device susceptible to destruction due to hits by the pursuing aircraft.

The various visual augmenters such as the banners, sleeves, and interconnected strands discussed above, have also presented the problem of environmental impact. For those visual augmenters which are released before landing of the towing aircraft, there lies the possibility of the visual augmenter dropping into a body of water. This is especially true for the lighter banners which are more apt to be influenced by wind currents. The visual augmenters which fall into a body of water and are formed of relatively buoyant material such as polypropelene present a problem to fishermen and the like in that the visual augmenters tend to tangle up in the netting used by fishermen and the propellers of both commercial and recreation boats. Prior art attempts to solve this problem have included the positioning of weights on the forward end of the visual augmenter. However, even with the weights attached to the forward end of the visual augmenter, portions of the visual augmenter tend to float upwardly towards the surface of the water thereby causing even a greater hazard due to difficulty in spotting the augmenters.

In addition, the visual augmenters of the prior art were prone to be difficult to visually detect due to a lack of visual acuity. This problem in visual detection being especially true for the individual strand configuration of the prior art as often the individual strands bellow outwardly decreasing contrast between the augmenter and the environmental background.

SUMMARY OF THE INVENTION

The present invention, among other things, presents a solution to the aforementioned problems associated with the prior art. In so doing, the present invention provides for the visual augmenter to be spaced well away from the forebody assembly carrying the radar or scoring device. To achieve this spacing, an extension device is utilized which has a front end attached to the rear end of a forebody assembly and a rear end attached to the visual augmenter. Hence, the extension device places the forebody assembly in a position which is less likely to be subjected to hits by pursuing aircraft. The extension device includes one or more riser lines extending either from a frame or swivel connection attached to the forebody assembly. A plurality of suspension lines extend from the end of each of the riser lines. The suspension lines extend outwardly away from the riser lines and are attached to a vented inflator which is attached to the forefront of the visual augmenter.

In the prior art systems referred to, the visual augmenter was connected to a frame structure which gave the front, open end of the visual augmenter the desired shape. This feature of using the frame structure attached to the forebody is not available when utilizing the present invention's flexible extension device which extends far from the frame. In other words, without a frame structure connected directly to the forward end of the visual augmenter, there exists the possibility of the visual augmenter losing its shape at the forward end.

The vented inflator of the present invention avoids this problem by creating the aerodynamic forces necessary to keep the forward end of a cylindrical type visual augmenter open and in an inflated condition. The vented inflator includes a forward hoop and a rearward hoop joined together by a plurality of flexible panels connected between the forward and rearward hoops. The panels are spaced from one another along the periphery of each of the hoops so as to create air vents between adjacent panels. The panels are also preferably connected to the hoops in a manner which prevents slippage of the panels along the hoop. Also, the forward hoop is larger than the rearward hoop such that when the forward and rearward hoops are tensioned the panels form a frusto conical rim at the forward end of the visual augmenter. The vented inflator thus acts to maintain the forward end of the visual augmenter in an open position.

The visual augmenter is generally cylindrical with an open front end and an open aft end which includes an adjusting device that enables the size of the aft opening to be adjusted. This adjustment feature allows for manipulation of the drag created by the visual augmenter. For situations in which the visual augmenter is to be towed at high speeds, it is preferable that the adjusting device create a large opening at the aft end of the visual augmenter. If lower speeds are anticipated then the adjustment device is preferably manipulated to create less of an opening at the aft end.

The visual augmenter is formed of mesh netting that is comprised of a plurality of strands which intersect one another to form a plurality of longitudinally extending diamond shaped openings. The strands are comprised of knitted threads and at the point of intersection of each strand some or all of the knitted threads (forming each strand) are knitted together so as to create the diamond shaped mesh netting. The arrangement of the inter-connected strands forming the mesh netting tends to reduce the drag of the visual augmenter. This reduced drag is due in part to the compression of the interconnecting strands caused by the wind forces acting on the visual augmenter. The mesh netting also tends to improve visual acuity by maintaining a compacted condition rather than a bellowing configuration as experienced in the prior art. The mesh netting also increases the useful life of the visual augmenter even after repeated hits. In the event that a hit tends to puncture a hole or sever a strand in the mesh netting there is no adverse affect on the netting which surrounds the point of impact and holds the device together. The visual augmenter of the present invention is also not as susceptible to floating when material such as nylon is used as the threads for knitting the individual strands that are joined together to form the mesh netting. The mesh netting also tends to become entangled along its entire length with the various elements lying on the underwater surface. The use of lead weights further ensures that the visual augmenter will not easily drift with the wind currents and will remain on the bottom of a body of water into which the visual augmenter drops.

One embodiment of the invention has, by way of wind tunnel tests, proven particularly suited for aircraft which are capable of travelling at speeds between 240–500 KNTS during a dragging run. In this embodiment, the vented inflator includes forward and rearward connection means that, when in operation, assume a circular configuration. The forward connection means features a first webbing member circular in shape and preferably in the form of a strap made of nylon. The forward connection means can also include a second webbing member also preferably in the form of a strap made of nylon.

The rearward connection means features a nylon strap having a circular configuration which is of a lesser diameter than that of the first and second webbing members.

A plurality of attachment members extend longitudinally and in spaced relationship between the forward and rearward connection means. One end of the attachment members is attached to the nylon strap forming the rearward connection means. The attachment members include a body section which is attached to the forward connection means as well as a second end which is also attached to the forward connection means such that a loop is formed which extends out away from both said forward and rearward connection means.

Because the rearward connection means is of a lesser diameter than the forward connection means, the attachment members are at an incline as they extend between the forward and rearward connection means. In addition, the securement of the end of the attachment members and the rearward connection means is such that the strap member of the rearward connection means is inclined so as to have a planar surface confronting the air rushing into the vented inflator.

A visual augmenter, which is preferably the same as the mesh netting previously described, is sandwiched between the first and second webbing members. In addition, the attachment members are arranged to have a first portion sandwiched between the first and second webbing members, a second portion which forms the aforementioned loop and a third portion attached to the underside of the second webbing member. The two webbing members, the mesh netting and the first and third portion of the attachment members are joined together such as by way of a stitching process.

A bead, which can be a circular nylon rope, is positioned forwardly to one side of the first and second webbing members and attached to the mesh netting such as by a thread looping through the mesh netting and around the bead.

A plurality of suspension lines include loops which extend through the looped second portion of the attachment members. The suspension members can be made to converge to a common point for ease in interconnection with a dragging line or tow cable.

While in operation, the in rushing air acts to inflate the vented inflator and also the forward end of the visual augmenter wherein the entire visual augmenter can then be inflated as well. The incline of the attachment members and rearward connection means assist in ensuring the visual augmenter is inflated and maintained inflated. The visual augmenter is also, however, designed to keep drag to a minimum and the air vents formed between the attachment members allows for use of the target with higher speed aircraft without early degradation of the target. Thus, the target can be used for repeated and extended runs which can reduce substantially the cost of target practice and allow for prolonged pursuit.

BRIEF DESCRIPTION OF THE DRAWINGS

The present invention will be more fully understood from the detailed description given hereinbelow and the accompanying drawings which are given by way of illustration only, and thus are not limitative of the present invention, and wherein:

FIG. 19 shows a front view of that which is shown in FIG. 18;

FIG. 20 shows a cutaway view of the interior of the visual augmenter shown in FIG. 18;

DETAILED DESCRIPTION OF THE PREFERRED EMBODIMENTS

Figure 1:
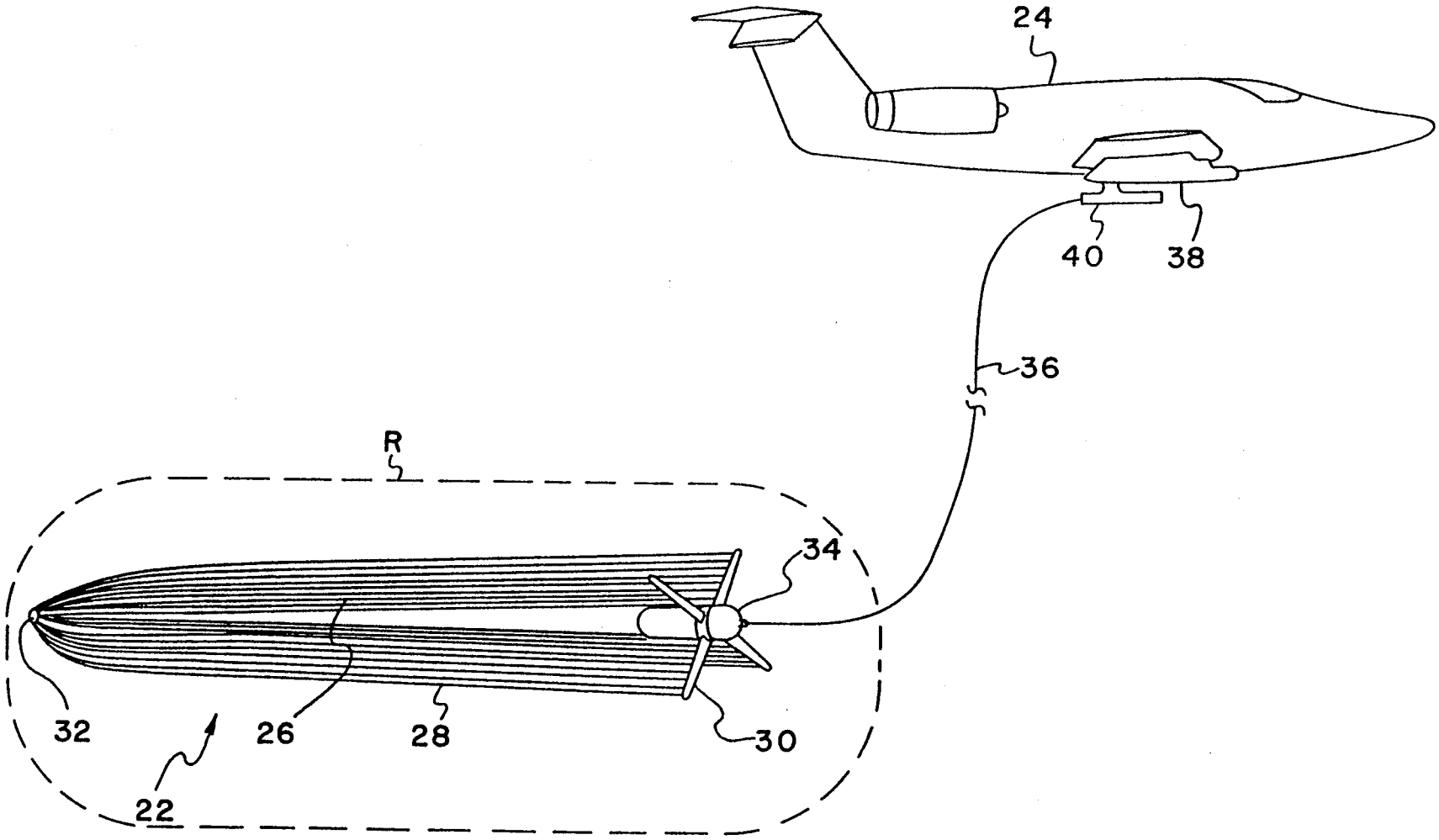
FIG. 1 PRIOR ART
FIG. 1 is a side view of a prior art aerial gunnery target being towed by a towing aircraft.

FIG. 1 shows a prior art aerial gunnery target 22 being towed by towing aircraft 24. Aerial gunnery target 22 includes visual augmenter 26 formed of a plurality of individual strands 28 which are connected to the branches of frame 30. A plurality of the individual strands are arranged in series along each of the branches of frame 30 and extend rearwardly to a point of connection made possible by cap 32. Radar detection device 34 is positioned at the center of frame 30 and creates radar zone R. A pursuing aircraft (not shown) pursues the usually brightly colored visual augmenter 22 and attempts to shoot within zone R while preferably avoiding direct hits to visual augmenter 22 and the other components of visual augmenter 22. Scoring is achieved electronically by determining the position and number of shots passing through the radar zone R. Radar device 34 is attached at its forward end to tow line 36 which is attached to reeling mechanism 38. Tow line 36 usually extends to about 2,000 feet behind the towing aircraft. During take-off, aerial gunnery target 22 is stored in canister 40 and at some point during flight canister 40 is opened and aerial gunnery target 22 is deployed.

Figure 2:
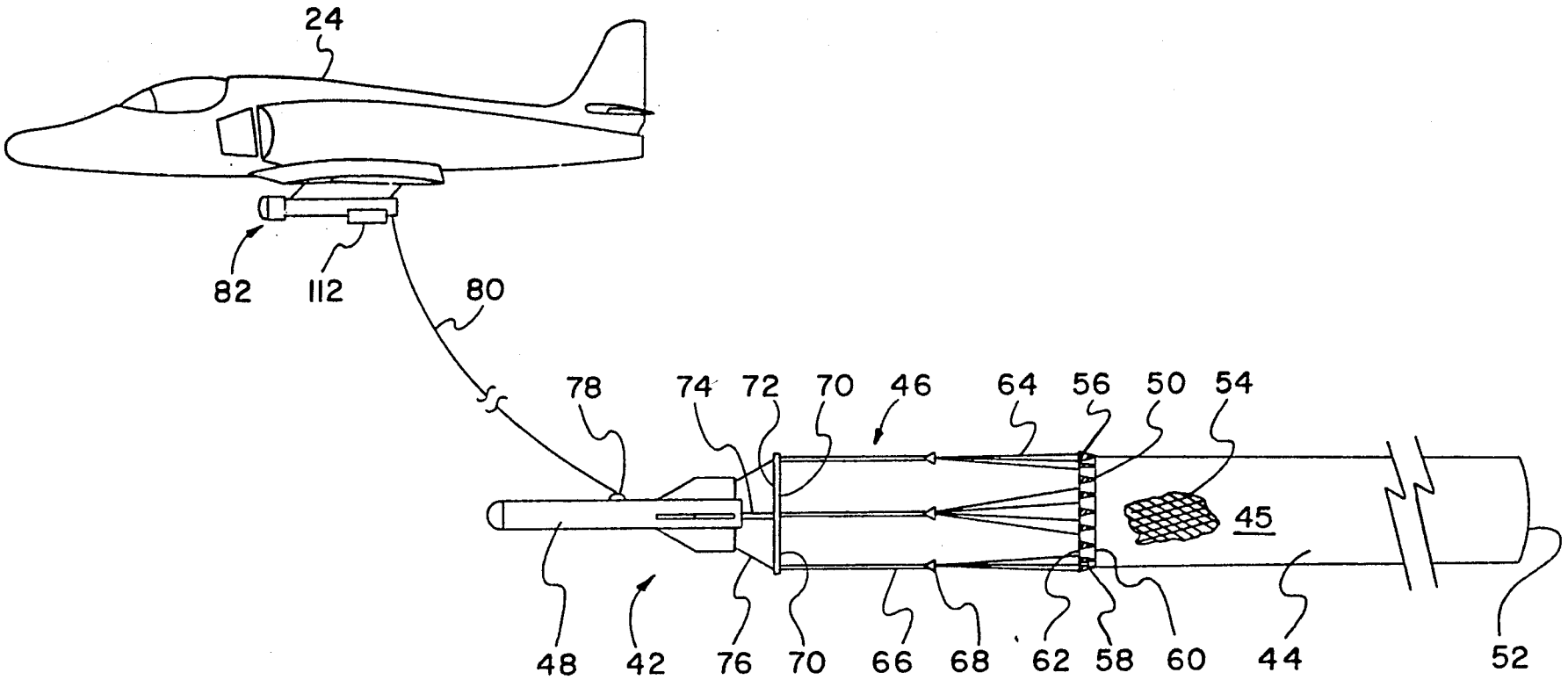
FIG. 2 is a side view of an embodiment of the present invention being towed by a towing aircraft.

FIG. 2 shows a preferred embodiment of the present invention which includes aerial gunnery target 42 comprising a visual augmenter 44, vented inflator 56, extension device 46 and forebody assembly 48. Visual augmenter 44 is preferably cylindrical in shape having an open forward end 50 and a completely open or partially open aft end 52. A length of about 16 feet and an external diameter of 30 inches has proven satisfactory for the purposes of this invention. Visual augmenter 44 is preferably formed of meshed netting 54, the details of which are discussed hereafter.

At the forefront of visual augmenter 44 is connected vented inflator 56 which includes a plurality of spaced flexible panels 58 attached between forward hoop 62 and aft hoop 60. Suspension lines 64 are attached at one end to forward hoop 62 and at their other end to riser lines 66. Suspension lines 64 preferably are in sets of four that diverge outwardly from fixation point 68 which coincides with the rearward end of each of the riser lines 66. The rearwardmost ends of suspension lines 64 are spaced radially around forward hoop 62 and in between panels 58. The connection of the suspension lines 64 to hoop 62 is preferably such that suspension lines 64 retain their position without sliding along hoop 62. The forward end of each of riser lines 66 are connected to the extremities of branches 70 forming part of frame 72. Shaft 74 is attached at the locus of frame 72 and to the rear end of forebody assembly 48. For added stability, bracing members 76 extend between branches 70 and the rear end of forebody assembly 48.

Forebody assembly 48 includes tow line connector 78 to which tow line 80 connects. The opposite end of tow line 80 is attached to reeling device 82 positioned either on the wing or the fuselage of towing aircraft 24.

Figure 3:
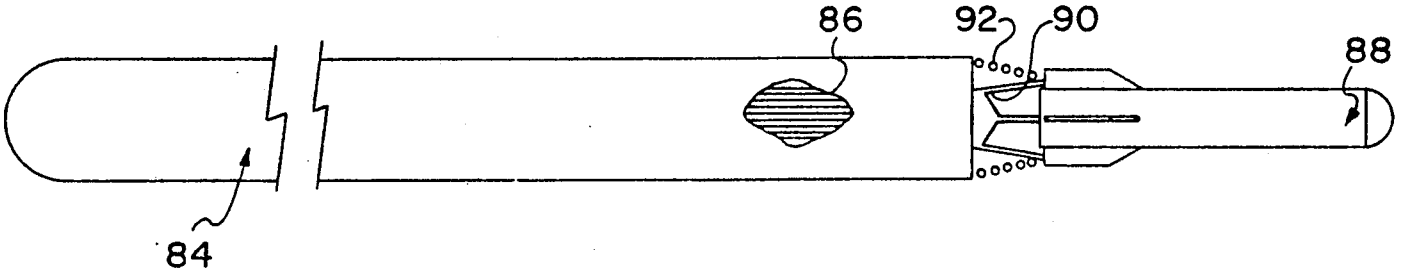
FIG. 3 PRIOR ART
FIG. 3 is a side view of a prior art aerial gunnery target.

FIG. 3 shows another prior art aerial gunnery target having visual augmenter 84 comprised of individual strands 86 similar to those found in FIG. 1. Forebody assembly 88 includes frame 90 and braces 92 which are in direct contact with the forward end of visual augmenter 84. Frame 90 acts to maintain the forward end of visual augmenter 84 in an open position.

Figure 4:
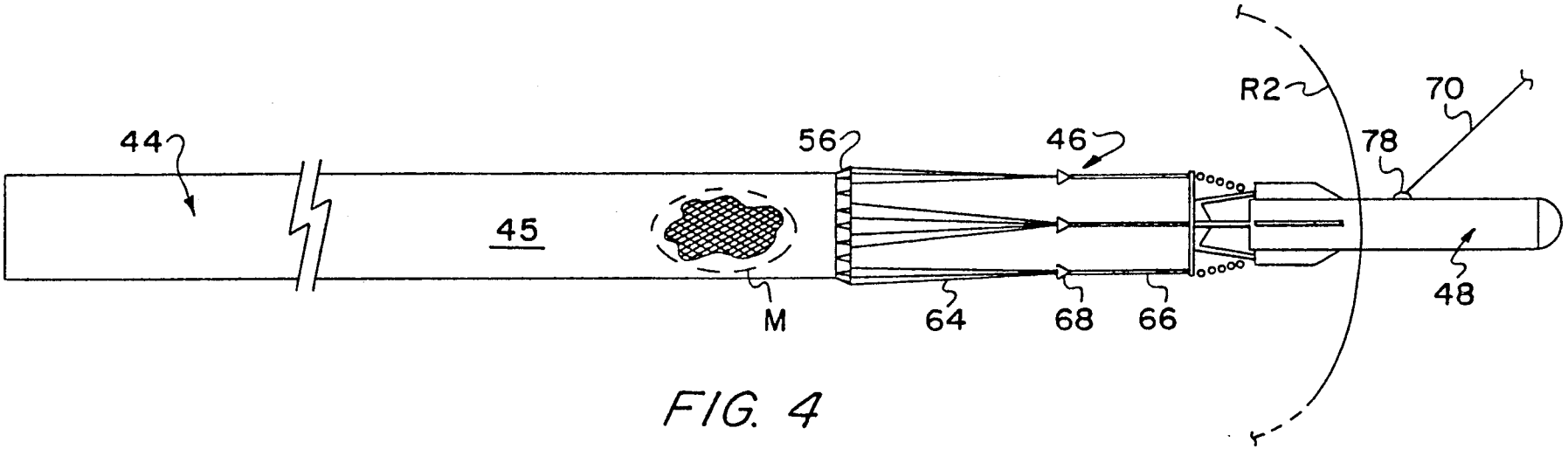
FIG. 4 is a side view of an embodiment of the present invention.
Figure 5:
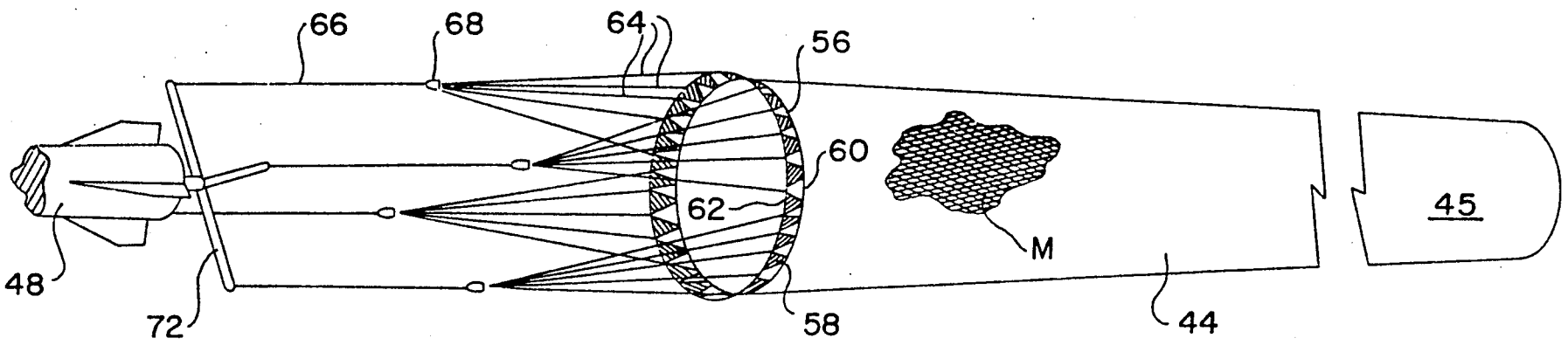
FIG. 5 is a perspective, partially cut-away view of the embodiment shown in FIG. 4.

FIGS. 4 and 5 further illustrate the visual augmenter of the present invention shown being towed in FIG. 2. Forebody assembly 48 includes radar capability which allows for radar zone R2 (partially shown) to be set up for scoring purposes.

Figure 6:
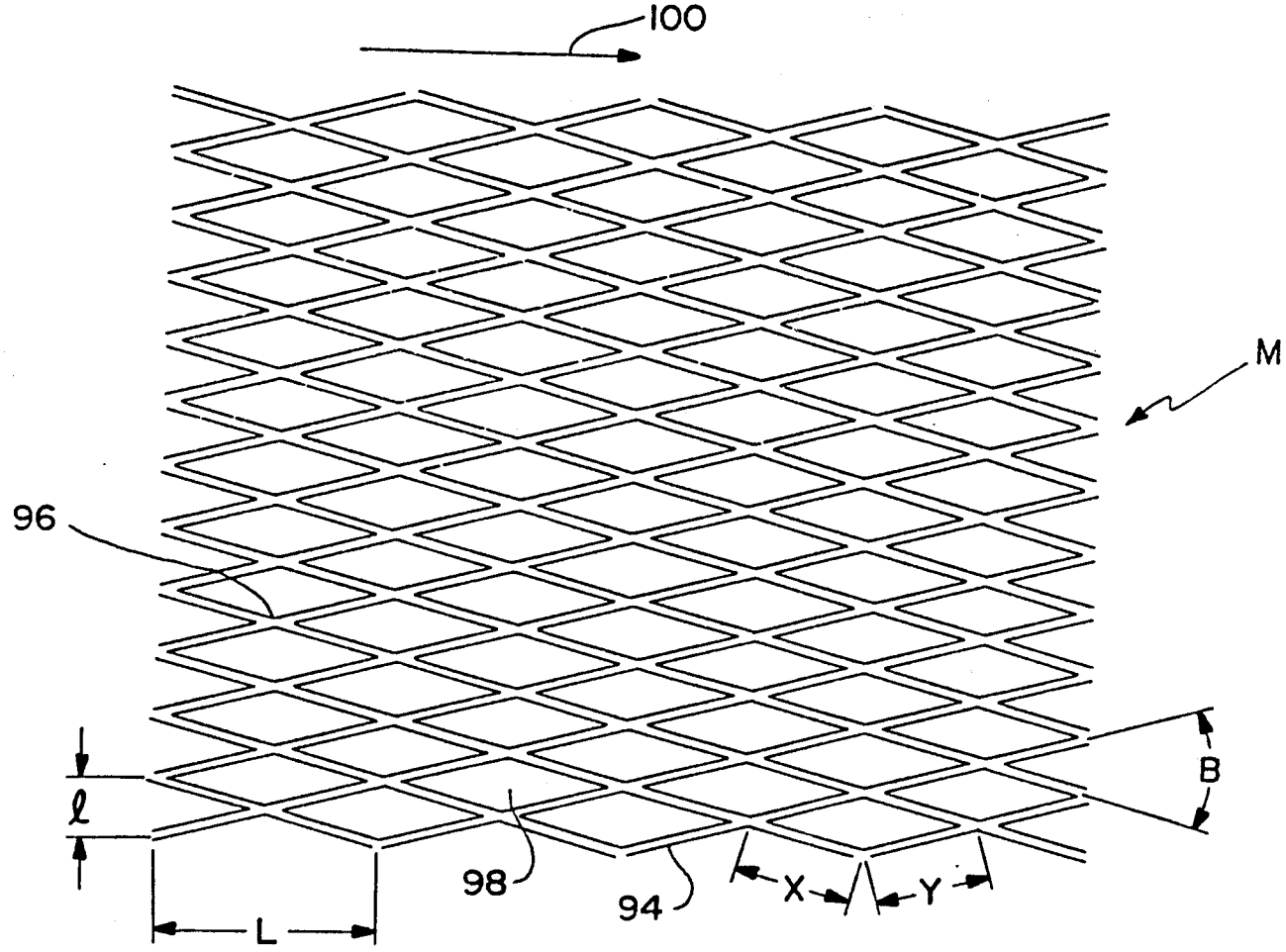
FIG. 6 is a close-up of the mesh netting forming the visual augmenter.

Visual augmenter 44 includes mesh netting M, only a portion of which is shown in detail for draftman's convenience. FIG. 6 shows in greater detail the arrangement of mesh netting M. Mesh netting M is formed of a plurality of interconnecting strands 94. Each of the strands 94 are formed of a plurality of knitted threads preferably comprised of nylon although other materials such as, but not limited to, cotton, polypropylene, polyethylene, or rayon might also be relied upon. At the points of intersection 96 of pairs of strands 94, the individual strands 94 are connected together by way of a knitting process which knits certain of the threads making up one of the two intersecting strands 94 with certain threads of the other interconnected strand 94. The individual threads which are knitted together to form strands 94 are preferably made from 1890 denier nylon thread. Various other ways of joining strands 94 together are also contemplated. For example, strands 94 can be joined together by knotting one strand to the other at their point of intersection. A knitted connection is, however, more preferable as it places less stress on the individual threads.

Strands 94 forming mesh netting M intersect one another at angle B which is preferably about 30° so as to create a plurality of diamond shaped openings 98. The longitudinal apex-to apex length L of each diamond is preferably within a range of about 1.22 to 1.28 inches or about 1¼ inches when mesh netting M is in a collapsed state (i.e., when length X and length Y are essentially planar). In addition, the lateral apex-to-apex length L of each diamond when mesh netting M is in an untensioned state is preferably within a range of about 0.320 to 0.340 of an inch and more preferably about ⅓ of an inch. Nylon diamond mesh netting suitable for the purposes of the present invention is a product of Blue Mountain Industries located in Blue Mountain, Ala. The netting sold by Blue Mountain Industries is referred to as "1¼ inch strength No. 189 knotless nylon netting".

The use of a plurality of knitted threads to form the individual strands and the joining of the strands by a knitting process to form mesh netting M, also provides an advantage with respect to reducing drag. Air flowing along the length of the visual augmenter causes the augmenter to assume a tensioned or stretched state. While in a tensioned state the individual threads of strands 94 compress together, thus decreasing the surface area in contact with the on rushing air stream. In addition, the arrangement of the interconnected strands of mesh netting M, with the diamond shaped openings, leads to one strand drawing an adjacent strand both rearwardly and closer to itself. This arrangement tends to compress the entire body of augmenter 44 inwardly thereby lessening the degree of drag caused by the visual augmenter. Furthermore, the angular orientation of the rearwardly extending strands, with respect to the on rushing air stream, is such that as the augmenter stretches further rearwardly at increased speeds the individual strands 94 tend to assume a position more and more in line with the direction of the on rushing air. This feature enables the augmenter to inherently adjust the degree of drag with increases in tow speed. Direction arrow 100 illustrates the direction of the air as it passes along the length of visual augmenter 44.

FIG. 5 shows vented inflator 56 in an inflated condition. In this condition, vented inflator 56 provides the necessary tension in hoops 60, 62 to form an inlet for a highly porous visual body such as visual body 45 formed of mesh netting M. Vented inflator 56 also performs the function of obtaining and maintaining a cylindrical shape in the visual augmenter by utilizing the local airstream as the energy source.

Figure 5A:
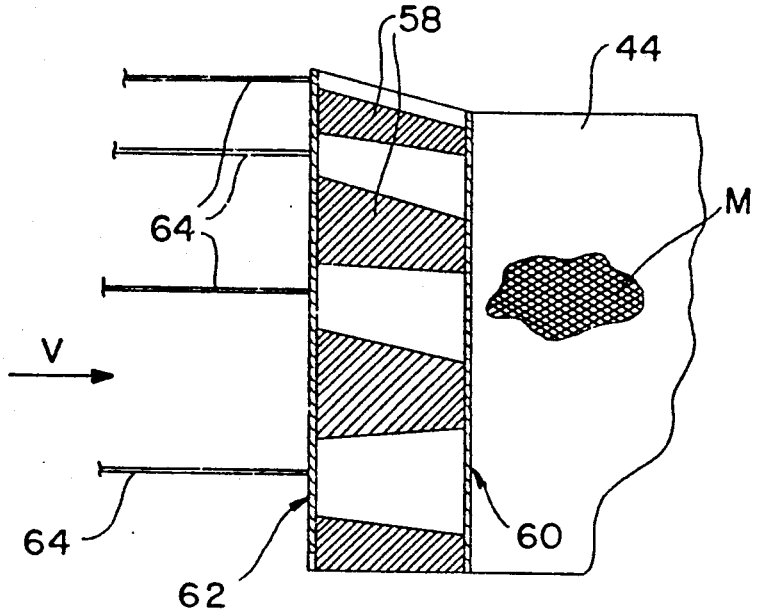
FIG. 5A and 5B are partially cut-away views of the vented inflator shown in FIG. 5.
Figure 5B:
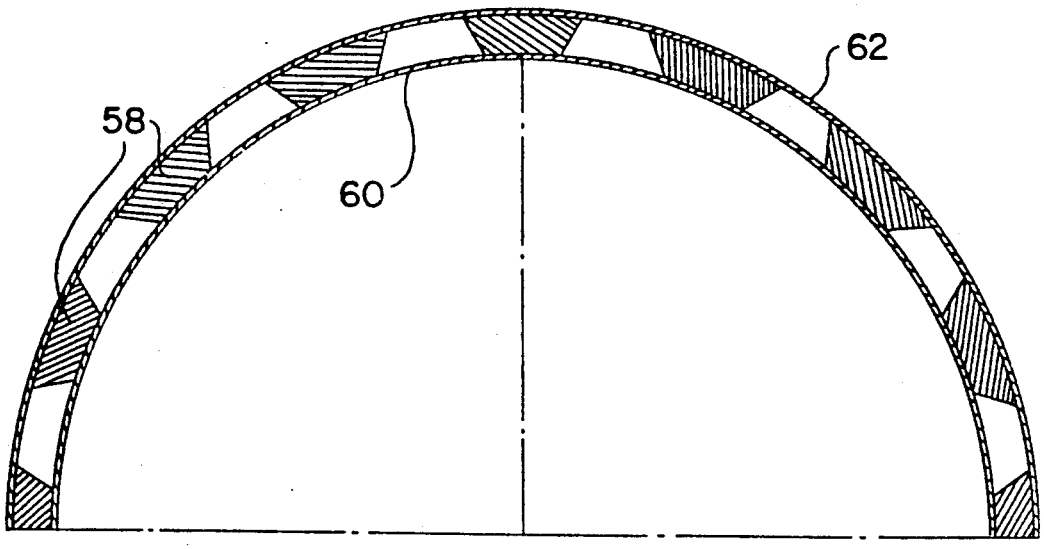

As more fully illustrated in FIGS. 5A and 5B, vented inflator 56 includes a number of panels 58 attached to forward hoop 62 and aft hoop 60. Hoops 60 and 62 are preferably formed of a flexible cable comprised of a material such as nylon. In a preferred embodiment the cable is made up of a plurality of braided nylon fibers which when combined provide a cable having a cross-sectional diameter between about 3/16 of an inch to ¼ of an inch. A diameter for hoops 60 and 62 which is suitable for the purpose of the invention is about 32.6±0.5 and 30.0+0.5 inches, respectively. Hoops 60, 62 are also preferably formed in circular or ring-like fashion. The diameter of forward hoop 62 is larger than the diameter of aft hoop 60 by an amount which causes panels 58 to assume an angle of attack that preferably falls within a range of about 12 degrees to 18 degrees and more preferably is approximately 15° relative to the direction of the local airflow. Various other angles would also be possible depending on the variables involved such as anticipated towing speeds, hoop dimensions, etc. In achieving a 15° angle of attack, forward hoop 62 would preferably have a diameter which is larger than that of aft hoop 60 by a ratio of about 1.087 to 1.0.

The positioning of panels 58 at an angle of attack of about 15° (see FIG. 11) provides sufficient hoop tension (brought about by aerodynamic forces acting on the panels) to keep the forward end of a cylindrical visual augmenter open and thus enable the visual augmenter to remain in an inflated condition. Furthermore, a 15° angle of attack provides sufficient aerodynamic loading to provide the required hoop tension while at the same time minimizing the drag or force in the actual direction of the visual augmenter.

In a preferred embodiment vented inflator 56 includes 16 truncated triangular shaped panels 58. Panels 58 are uniformly positioned with space between each panel and attached to hoops 60, 62 to provide a porosity ratio (panel area/total area) of about 0.5 for the inflator and more preferably about 0.484.

Figure 7A:
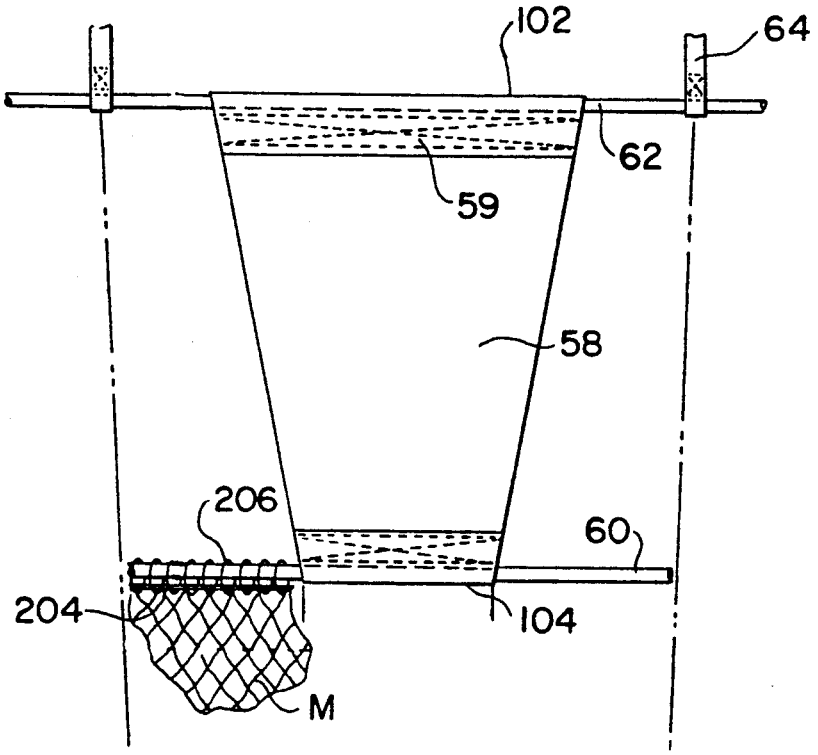
FIG. 7A is a planar view of one of the panels forming the vented inflator shown in FIGS. 5A and 5B.

FIG. 7A shows the finished flat pattern for a preferred embodiment, as well as the spacial location relative to 1/16 of the area of vented inflator 56, which is equivalent to a 22.5 degree segment of the inflator. Each truncated panel 58 has its forward edge looped over and sewn or fastened to form a passageway for accepting forward hoop cable 62. After cable 62 has been inserted through the loops of panels 58, each panel is positioned with an equal separation space which, with a 32.6 inch diameter forward hoop, proves to be about 2.4 inches. The ends of the cable for hoop 62 are then securely fastened together to form the final configuration of hoop 62. Similarly, the cable for aft hoop 60 is inserted through loops formed in the aft end of each panel with equal separation spaces of about 3.9 inches and the ends of the cable forming aft hoop 60 are joined to form the final configuration of aft hoop 60.

Figure 7B:
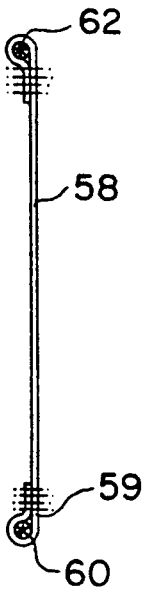
FIG. 7B shows a cross-sectional side view of a panel and the manner in which the panel is connected to the hoops.

FIG. 7B illustrates the manner in which the forward and rearward ends of panels 58 are looped about forward and aft hoops 60,62. A box-stitching or the like is provided which creates a snug connection between hoops 60, 62 and the looped portions of panels 58. In this way, panels 58 do not shift in position with respect to hoops 60, 62. Further contemplated methods for ensuring that panels 58 remain in fixed position with respect to hoops 60, 62 include having threads pass through the braided cable as well as the ends of panel 58 when the loops are formed. Alternatively, adhesives could be used to prevent slippage of panels 58. The rearward edge 104 of panel 58 is preferably about half the length of forward edge 102 or about two inches. The distance between forward edge 102 and rearward edge 104 as shown in FIG. 7A is preferably about 5 inches. Various other dimensions are also possible depending upon factors such as, for example, the anticipated speeds of towing, the size of the visual augmenter and the materials relied upon.

Figure 7C:
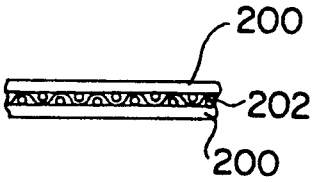
FIG. 7C shows a cross-sectional cut-away view of material forming the vented inflator panels.

Panels 58 are contemplated as being made of a high strength fiber material. A vinyl nylon cloth referred to as "U.S Government Part No. 13227E0131:MIL-C-20696 Type II, Class 1" having a breaking strength equal to about 225 lb for one inch wide strip is contemplated for use in the present invention. FIG. 7C shows in cross-section a preferred embodiment of panel 58 wherein two vinyl layers 200 are layered about a cloth (or fiber) weave or mesh 202. This arrangement further ensures that panels 58 are of sufficient strength to handle the forces that develop during high speed runs. An alternative approach contemplated is to apply a vinyl coating on both sides of a layer of mesh or cloth.

Vented inflator 56 is attached to suspension lines 64 as best illustrated in FIG. 7A. Suspension lines 64 have their ends looped about forward hoop 62 and box stitched to snugly fit about hoop 62 so as not to slide thereon. Additionally, various other means such as adhesives can be used to ensure no slippage of suspension lines 64 with respect to hoop 62. Visual augmenter 44 has at its forward edge a strip of material 204 which is connected to the individual strands forming the mesh pattern M. This strip of material is joined to aft cable 60 by lacing 206 which extends through the diamond mesh netting and around aft cable 60 and strip 204 in the open areas between adjacent panels 58. Lacing 206 is preferably formed of a waxed coated nylon material with the wax avoiding undue slippage while wrapping and knotting lacing 206 about both strip 204 and aft cable 60.

Figure 11:
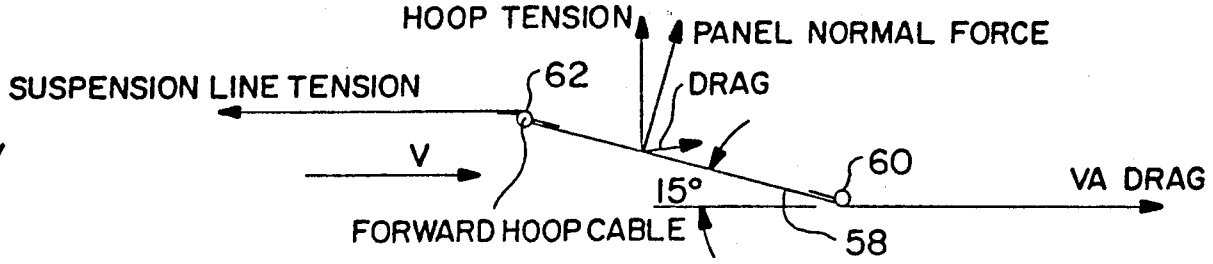
FIG. 11 shows a force diagram for the vented inflator panels while in a state of tension.

FIG. 11 provides a force diagram for panels 58 while in a tension state due to drag created by visual augmenter 44 and the tension placed on suspension lines 64. FIG. 11 also illustrates a 15 degree angle of attack for panel 58 shown in cross section. As can be seen in FIG. 11, panel 58 has its forward and rearward ends looped about hoops 60, 62. The forward and aft hoops 60, 62 are in tension resulting from the normal force created by the aerodynamic loading of panels 58. As a result of the larger diameter of forward hoop 62, in relation to the diameter of aft hoop 60, panels 58 are positioned within an approximate angle of attack of 15° relative to incoming air. The aerodynamic normal force of the panel can be broken down into two orthogonal components; the radial component (i.e. hoop tension) and the axial or drag component. The longitudinal tension required to maintain the preferred 5 inch separation distance between forward and aft hoops 60, 62 is provided by the opposing suspension line 64 tension acting forward and the visual augmenter 44 drag acting to the rear.

The spacial arrangement for panels 58 is configured to provide nearly equal size openings between each panel 58. With this arrangement, separation and the resulting turbulence of the local air stream over and around the panels is minimized. The spacial arrangement of the openings between the panels also provides a means for tailoring or optimizing the desired hoop tension over a wide variety of airspeed operations. The spacial arrangement of the panels 58 could vary in accordance with the specific requirements desired of the visual augmenter. A preferred embodiment has sixteen panels 58 spaced equally about forward and aft hoops 60,62.

Figure 12A:
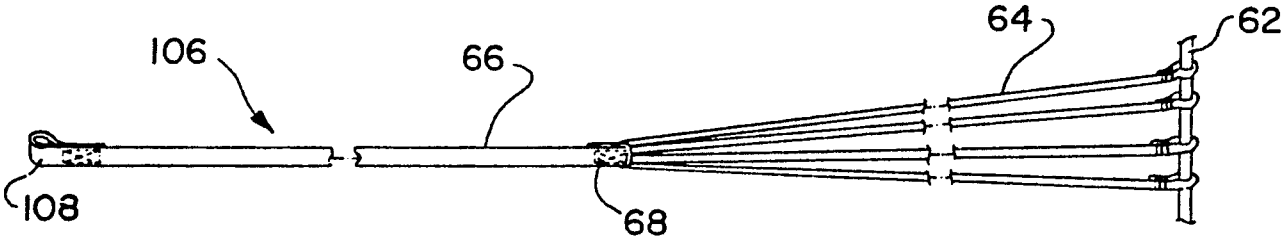
FIGS. 12A–12B show a cut-away view of the riser and suspension lines featured in FIG. 5.
Figure 12B:
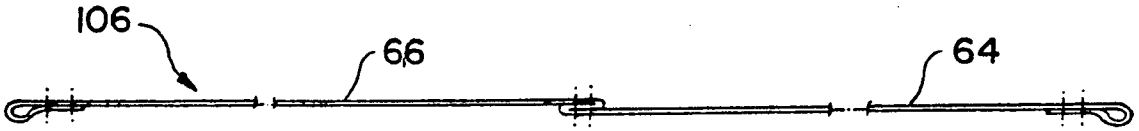

Tow harness 106 (shown in FIGS. 12A and 12B) is comprised of a plurality of riser lines 66 and suspension lines 64. In the embodiment shown in FIG. 2, four riser lines 66 are attached to frame structure at 72. Riser lines 66 are preferably about 5 feet in length and made from 1.75 inch wide U.S Government nylon webbing designated MIL-W-4088 Type VIII, Class 2 with a described breaking strength of 3500 lbs. To fixation point 68 (FIGS. 12A and 12B), is attached four suspension lines 64 each preferably made from ½ inch commercial grade nylon webbing having a described breaking strength of 500 lb. The four suspension lines 64, are attached to one of the four riser lines 66 at fixation point 68. This attachment is shown in FIG. 12A and FIG. 12B to be made by use of a box stitch. Similarly, suspension lines 64 are connected to forward hoop 62 by wrapping the end of suspension line 64 about hoop 62 and using a box stitch to keep it in place. The forward end of riser line 66 also includes loop section 108 which is connected to cable 116 (FIG. 16) that attaches to one of the branches of frame 72.

Figure 8:
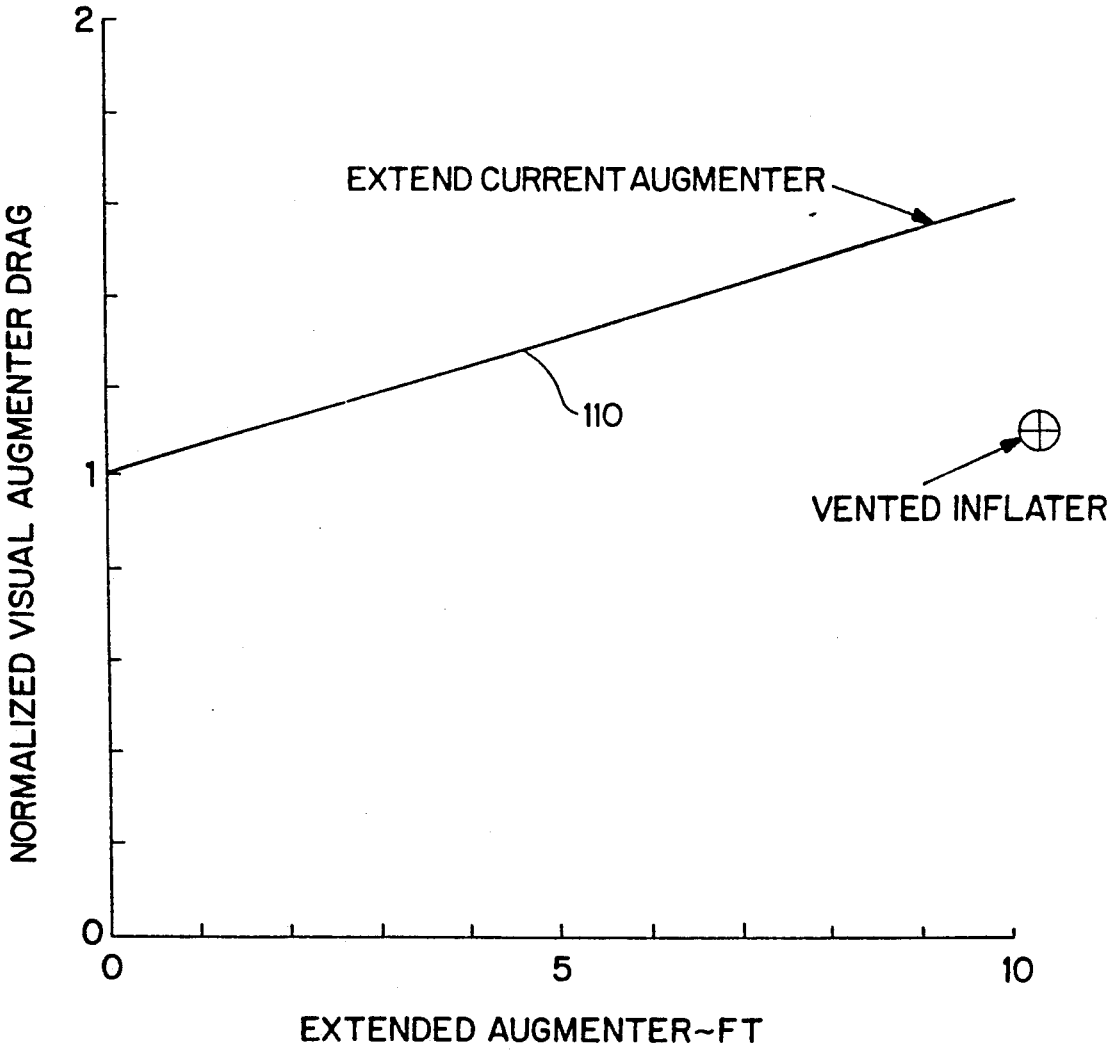
FIG. 8 is a graph which illustrates a calculated comparison of the drag experienced by an increased length visual augmenter with the drag of the present invention.

FIG. 8, which is based on calculations, depicts graphically the reduced drag made possible by the present invention. In FIG. 8 line 110 shows the increase in drag which would occur if a prior art visual augmenter such as that shown in FIG. 3 was increased an additional 10 feet. By utilization of suspension lines 64 and riser lines 66 each of about 5 feet in length, the entire length of the visual augmenter can be increased by about 10 feet. As set forth previously, the reliance on the combination of mesh netting M, vented inflator 56 and tow harness 106 allows for extension of the aerial gunnery target of the present invention while maintaining a reduced drag value. The aerial gunnery target of the present invention also enhances visual acuity of the target. The enhancement in visual acuity is made possible by the added length and, more importantly, the ability of the augmenter 44 to maintain a relatively uniform and condensed body which contrasts sharply against the environmental background. The vented inflator 56 assists in inflating visual augmenter 44 so as to maintain a generally cylindrical shape. Moreover, the passage of incoming air through vented inflator 56 and through the length of visual augmenter 44 helps prevent oscillation caused by external forces acting on the visual augmenter.

Figure 9:
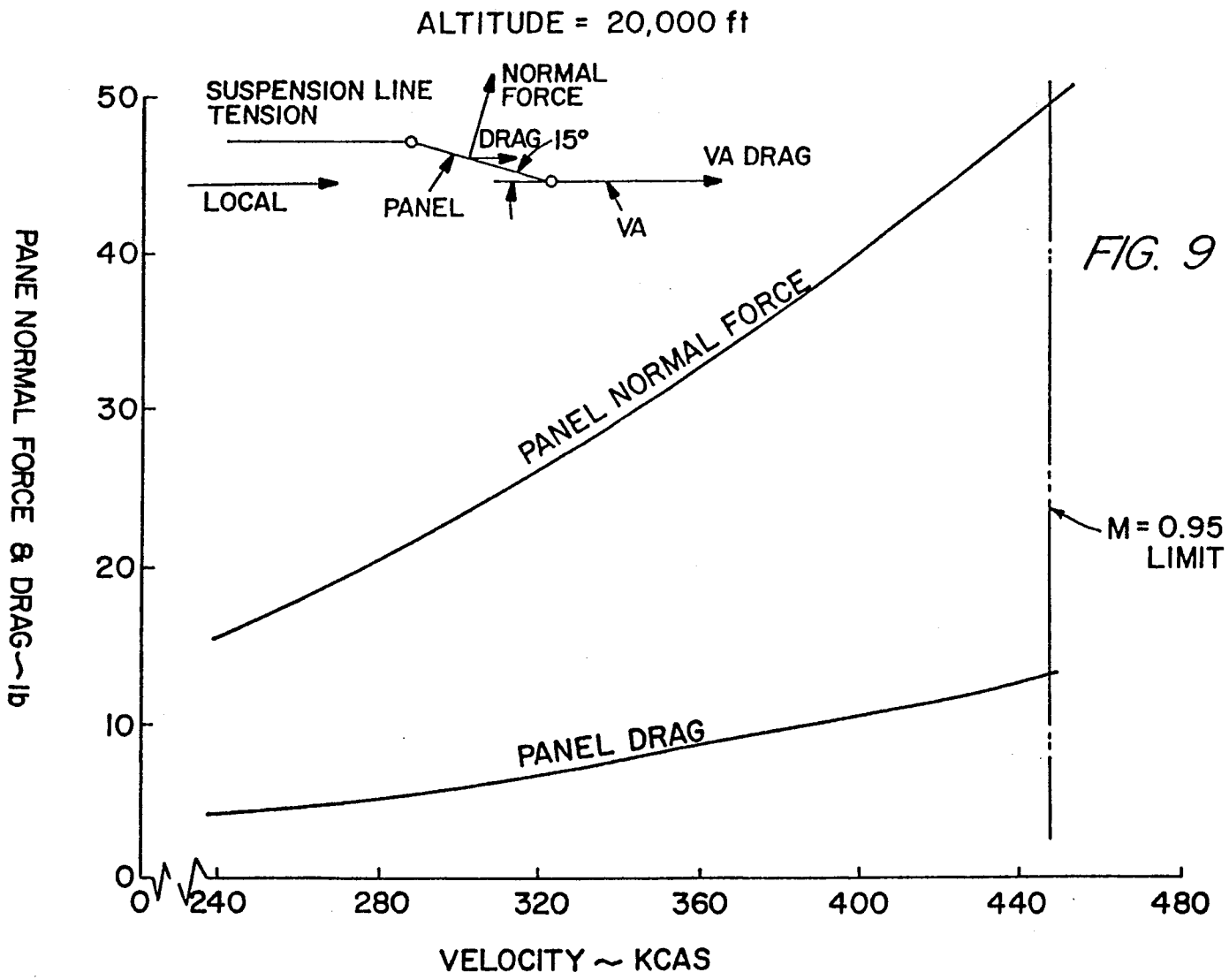
FIG. 9 shows an inflator panel's normal force and drag with respect to velocity.

FIG. 9 which is based on calculations depicts, graphically, the normal and drag forces which would be expected to develop in panels 58 in relation to the velocity of the towed visual augmenter. The limit value M shown in FIG. 9 is represented as 0.95 Mach or 448 KCAS [knots calibrated air speed]. FIG. 9 represents the normal and drag forces acting on panels 56 when at an attack angle of 15°. The material forming panels 56 as well as the manner of attachment to hoops 60, 62 must be capable of withstanding the forces shown in FIG. 9.

Figure 10:
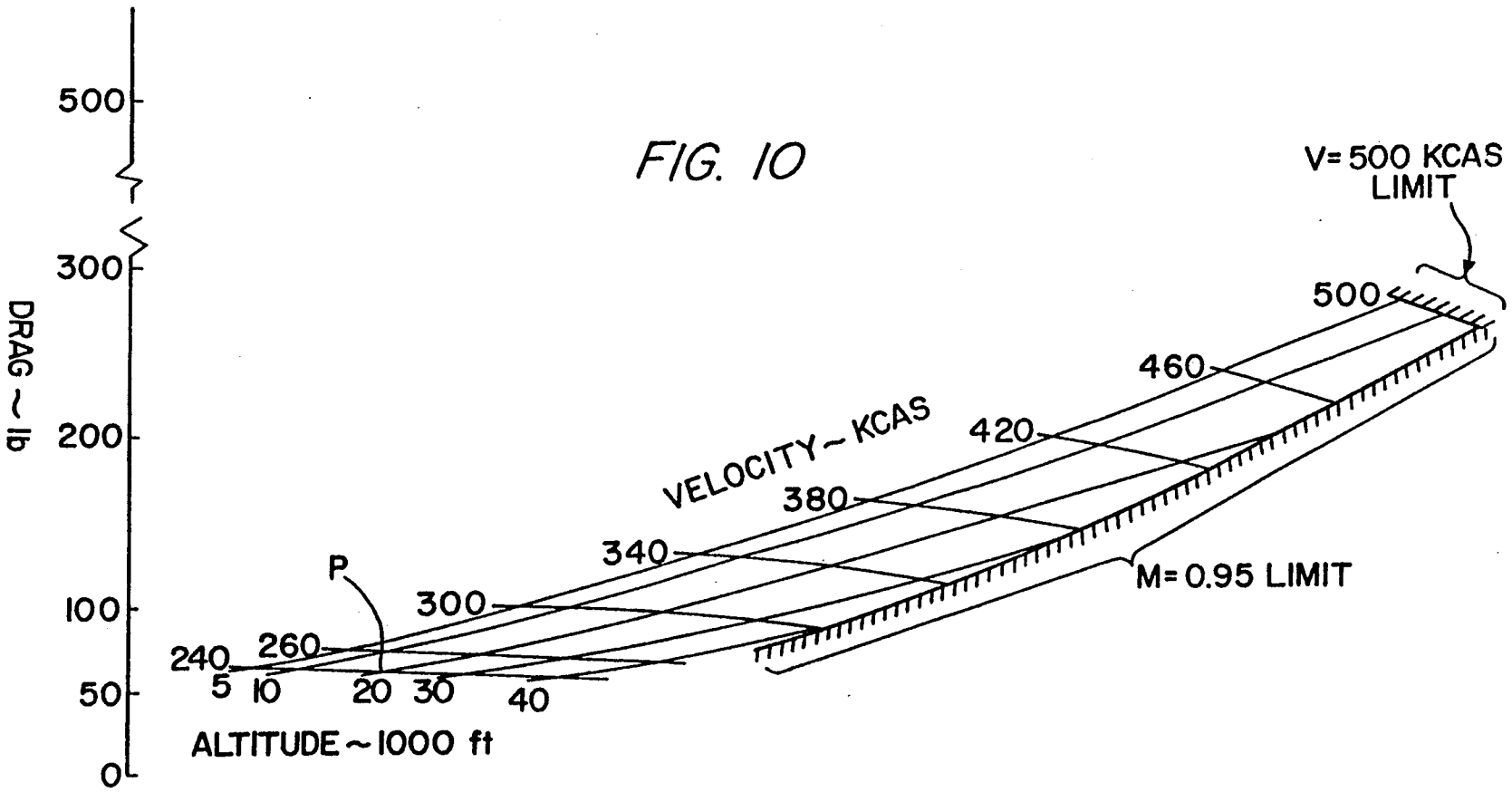
FIG. 10 shows the additional calculated drag increment resulting from the addition of a vented inflator.

FIG. 10 shows the calculated drag which can be expected due to the addition of vented inflator 56 to visual augmenter 44. FIG. 10 also reveals that the drag developed by including the vented inflator remains relatively low even up in the higher maximum speed regions.

Figure 15:
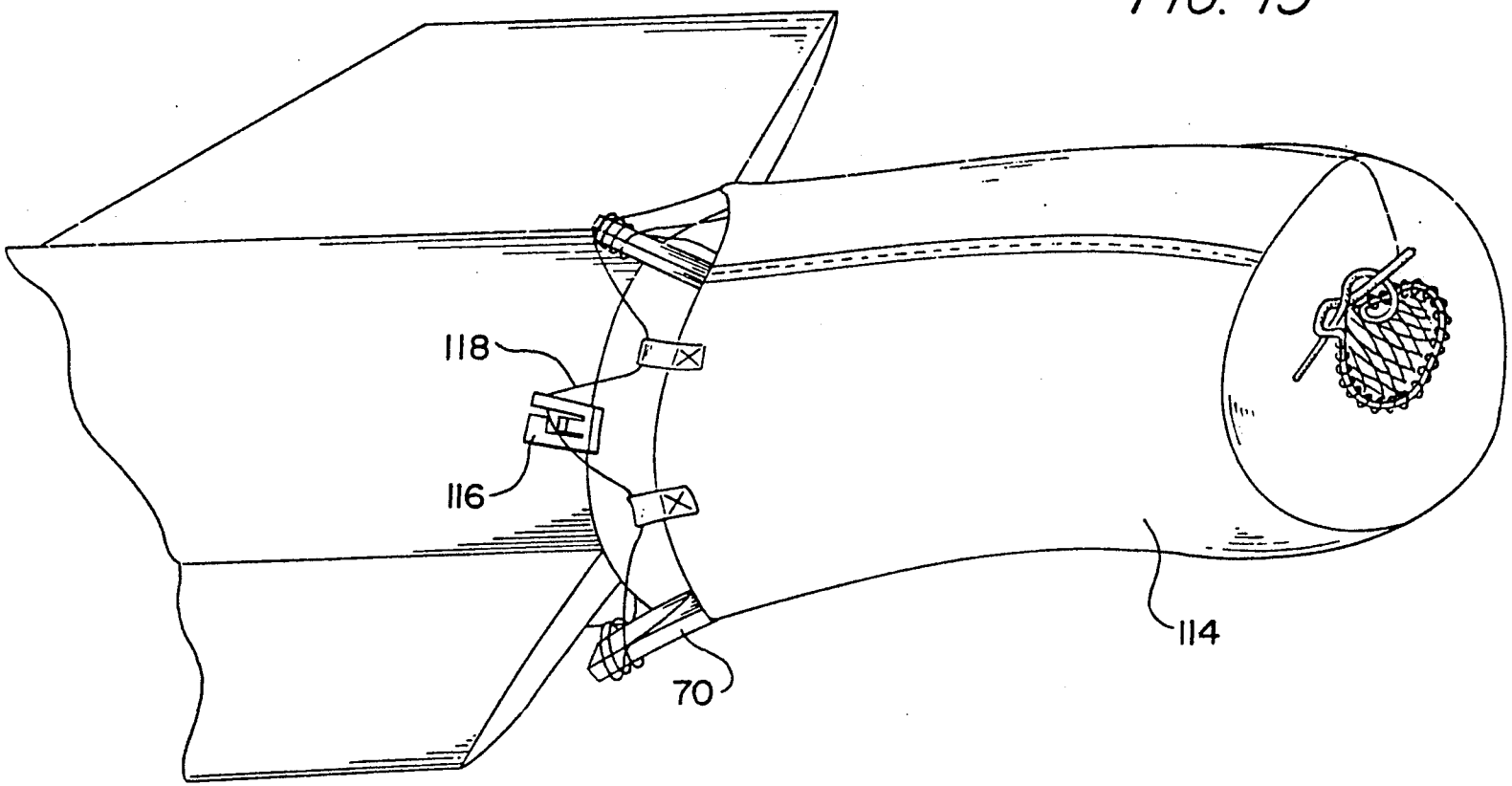
FIG. 15 shows the visual augmenter in a nondeployed state.

Returning to FIG. 2, reeling machine 82 is attached to the underside of one of the towing aircraft's wings. The reeling machine includes a releasable attachment device 112 that is capable of releasing forebody assembly 48 upon command of the pilot. In normal operation, visual augmenter 44 and towing harness 106 are contained within deployment bag 114 (FIG. 15) prior to deployment. While in flight above the predetermined target area, cutter mechanism 116 (FIG. 15) is activated (e.g. by an electronic signal) so as to cut the deployment line 118. Once deployment line is cut, branches 70 begin to extend outwardly and deployment bag 114 is drawn from its covering position. After bag 114 is drawn off by drag forces, the drag forces further act to deploy visual augmenter 44. Thereafter, forebody 48 is detached from attachment device 112 and reeled outwardly along tow line 80 (FIG. 2) until the visual augmenter 44 is the desired length away from the towing aircraft (e.g. 2,000 feet).

In operating an aerial gunnery target such as that of the present invention it is necessary to exclude the use of radar reflective type material within the scoring pattern envelope, i.e., visual augmenter 44 and the surrounding area within radar zone R2. If radar reflective material is used in the visual augmenter, vented inflator or in the towing harness it is highly probable that the unsteady highly cyclic vibrational type motion of the augmenter will result in false scoring outputs of the radar scoring system. The radar return of this motion can easily be misinterpreted by the scoring system as munition rounds passing through the scoring envelope. Accordingly, the present invention relies on a towing harness and visual augmenter formed of material which is not radar reflective. The foregoing discussion indicates that various materials such as nylon have proven suitable for the purposes of the present invention.

Referring again to FIG. 15, it is apparent that storage volume constraints also influence the design concept of a visual augmenter inflator. The flexible panel/hoop cable design of the vented inflator 56 provides a non-rigid highly flexible structure that can be folded or packed into virtually any shaped storage container or storage envelope so as to minimize storage volume requirements. The flexible riser and suspension lines are also easily folded up within storage container 114.

Following the desired target practice, the gunnery target is reeled in until forebody 48 becomes reattached to attachment device 112. Visual augmenter 44 and towing harness 106 are then released and allowed to drop to the ground or body of water below.

Figure 16:
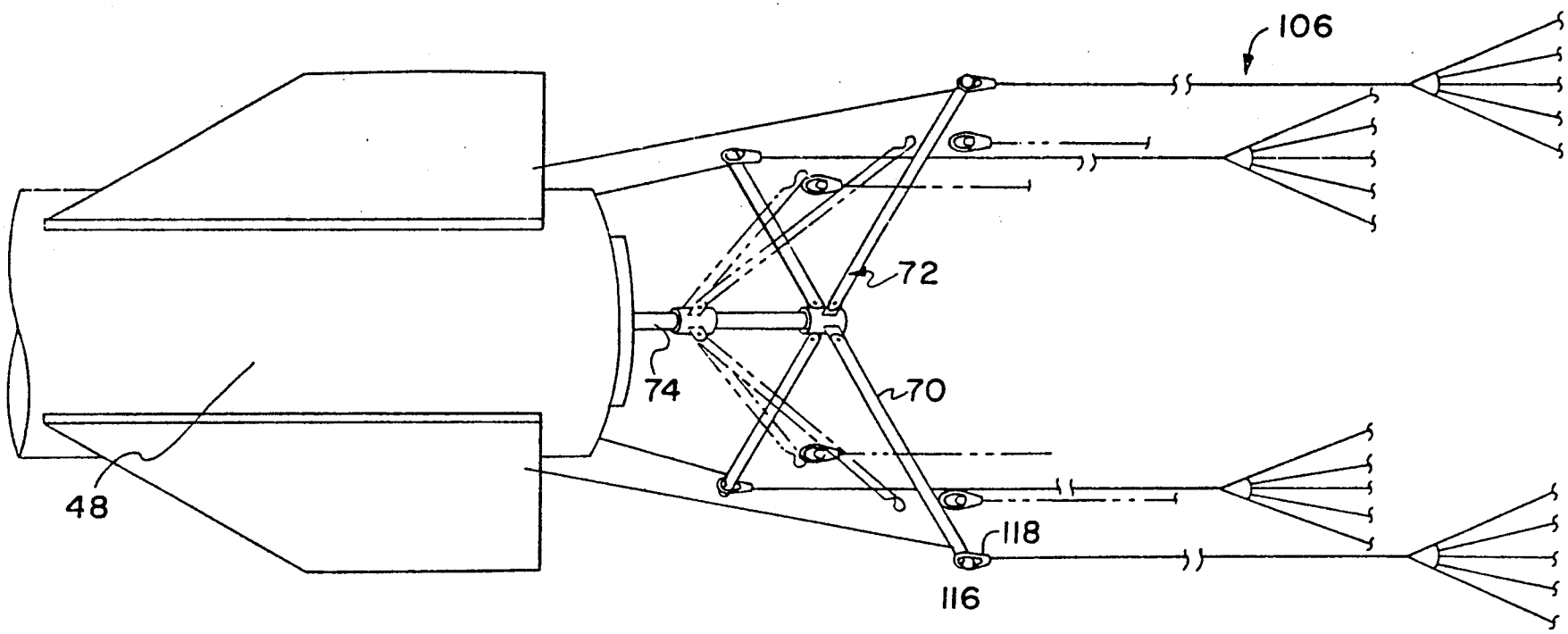
FIG. 16 shows a close-up view of the frame assembly positioned behind the forebody assembly.

FIG. 16 illustrates the manner in which towing harness 106 is disconnected from frame assembly 72 which is attached to shaft 74. To release tow harness 106, shaft 74 is drawn inwardly into the rear end of forebody assembly 48. This inward movement of shaft 74 causes branches 70 to collapse inwardly and in the rearward direction. Consequently, cable loops 116 and attached lead weights 118 are able to slide out of notches formed in branches 70 and become released as illustrated in dashed lines in FIG. 20. Visual augmenters 44 are then picked up upon landing on the ground or, if target practice is to take place over a body of water, visual augmenters 44 fall below the surface of the water and tend to remain entirely in contact with the underwater bottom surface.

Figure 17A:
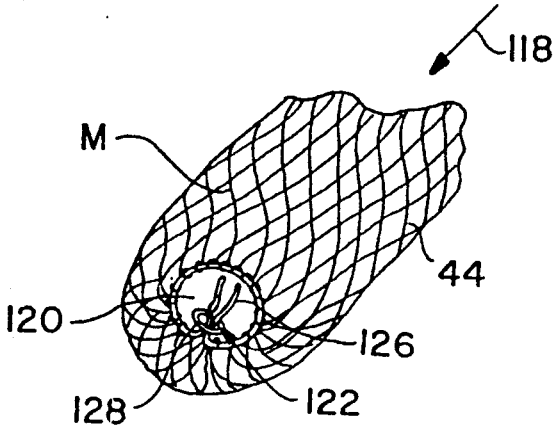
FIGS. 17A and 17B show the aft end of the visual augmenter cut-away from the remainder of the visual augmenter as well as the adjusting device positioned at the aft end.
Figure 17B:
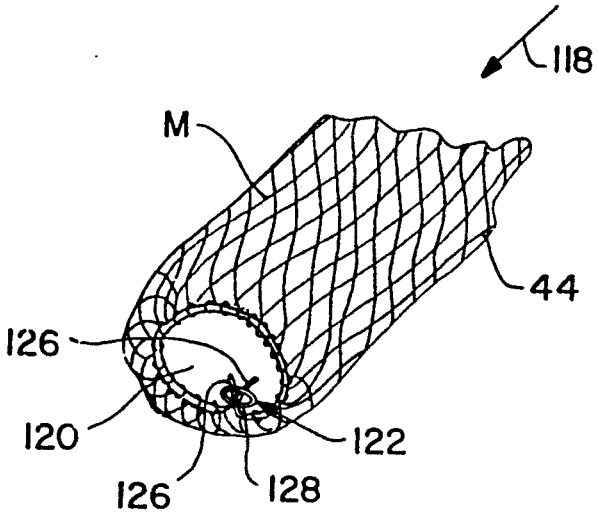

FIGS. 17A and 17B illustrate various sized openings at the aft end of visual augmenter 44. Air flowing through visual augmenter 44 in the direction of line 118 passes through opening 120. Drag can be increased by decreasing the size of opening 120. Hence, for slow speeds where it is desired to increase the drag of visual augmenter 44 so as to maintain proper positioning, the aft end opening 120 can be decreased in size as shown in FIG. 17A. Variations in the size of aft opening 120 are made possible by adjustment device 122 which includes a nylon cord 126 (or the like) passing within a sleeve provided at the aft end of mesh netting M. Cord 126 is shown as having two free ends which pass through adjustment clip 128. By drawing the free ends of cord 126 away from adjustment clip 128, the aft end opening 120 is made smaller.

Figure 13:
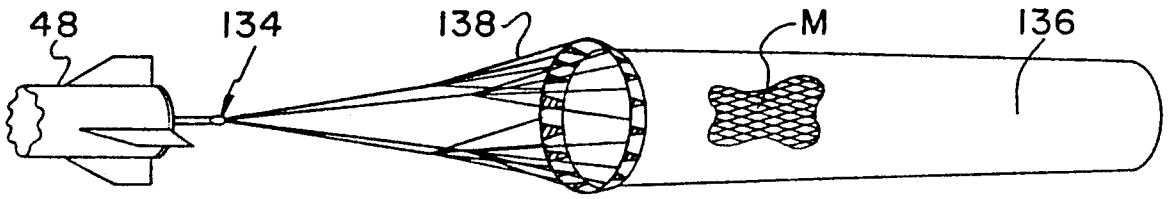
FIG. 13 shows an alternate embodiment of the present invention which utilizes a swivel connection between the forebody assembly and the riser lines.
Figure 14:
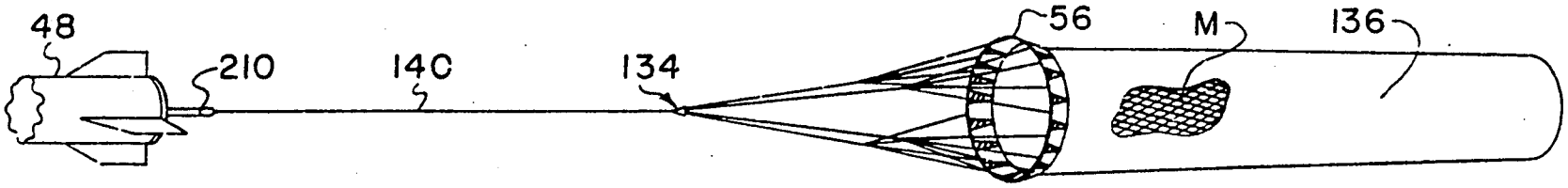
FIG. 14 shows another embodiment of the present invention which has a swivel connection and a drag line connecting the forebody assembly to the riser lines.

FIGS. 13 and 14 show two alternate embodiments of the present invention. In FIG. 13, swivel connector 134 allows for visual augmenter 136 and extension device 138 to freely rotate with respect to forebody assembly 48. Other than the swivel connector between forebody assembly 48 and extension device 138, all other features are similar to that of the visual augmenter illustrated in FIG. 2. FIG. 14 is essentially the same as FIG. 17 except for the addition of drag line 140 between forebody assembly 48 and swivel connector 134. In utilizing the embodiments of FIGS. 13 and 14, detachment of visual augmenter 44 is made simple in that all that is required is a release of the swivel connector 134 or, alternatively, connection device 210 shown in FIG. 14.

As can be seen, the addition of vented inflator at the forefront of the visual augmenter provides a great deal of freedom in determining how the visual augmenter is to be attached to a forebody assembly or, alternatively, directly to the end of a tow cable. The vented inflator makes unnecessary the use of frame structures to maintain the front opening of a visual augmenter in an open state. Moreover, the vented inflator of the present invention allows for non-rigid and non-radar reflective material to provide the required opening at the front of a visual augmenter.

Figure 18:
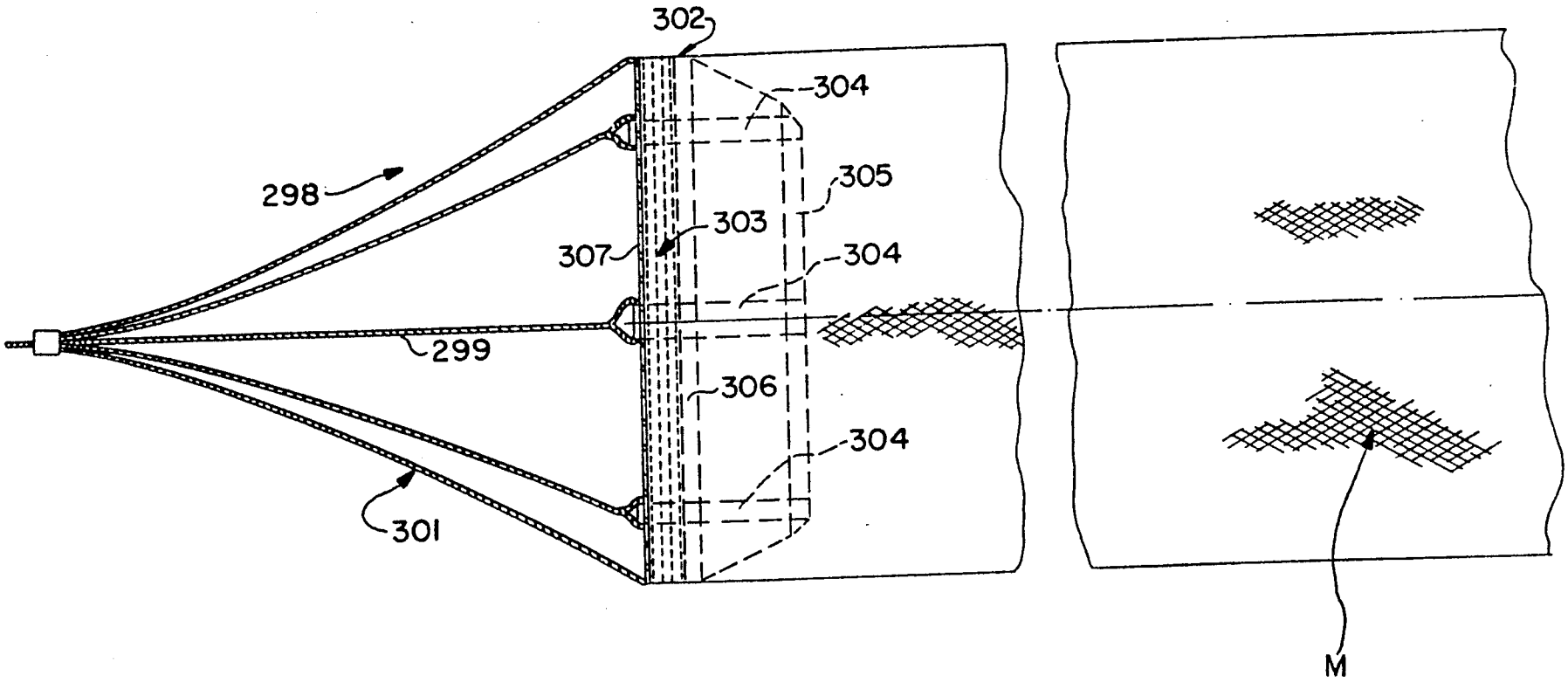
FIG. 18 shows a side view of an alternate embodiment of the present invention.

FIG. 18 shows a side view of an alternate embodiment of the present invention. In FIG. 18, aerial gunnery target 298 features suspension line assembly 301 with suspension lines 299. Attached to the rearward end of suspension line assembly 301 is vented inflator 302 which includes hoop shaped forward connection means 303 and hoop shaped rearward connection means 305 longitudinally displaced from one another. A plurality of attachment members 304 extend between the forward and rearward connection means.

FIG. 19 shows the front view of aerial gunnery target 298 having suspension line assembly 301 with suspension lines 299 extending to a common connection point. At the forward portion of vented inflator 302 is bead 307. As shown, attachment members 304 incline inwardly to connect with rearward connection means 305 to form a plurality of air vents 312.

FIG. 20 illustrates in greater detail the forward end of aerial gunnery target 298. Suspension line 299 includes a looped end which is connected to loop 314 (FIG. 21A) formed in the forward end of each of the attachment members 304. Bead 307 is shown to extend through loop 314 and includes thread 308 which interconnects bead 307 with the visual augmenter represented by mesh netting M by looping and lacing thread 308 about bead 307 and the mesh netting's edge. Webbing strip 306 is shown to be positioned inside of mesh netting M and to the outside of a portion of attachment member 304.

Figure 21B:
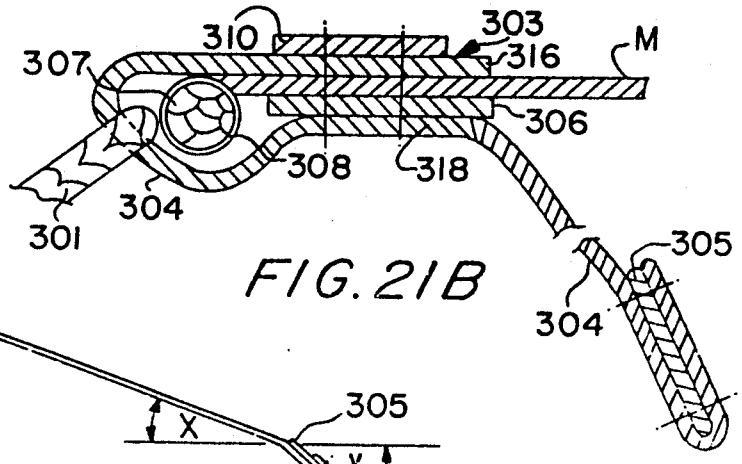
FIG. 21B shows in greater detail that which is shown in FIG. 21A.
Figure 21A:
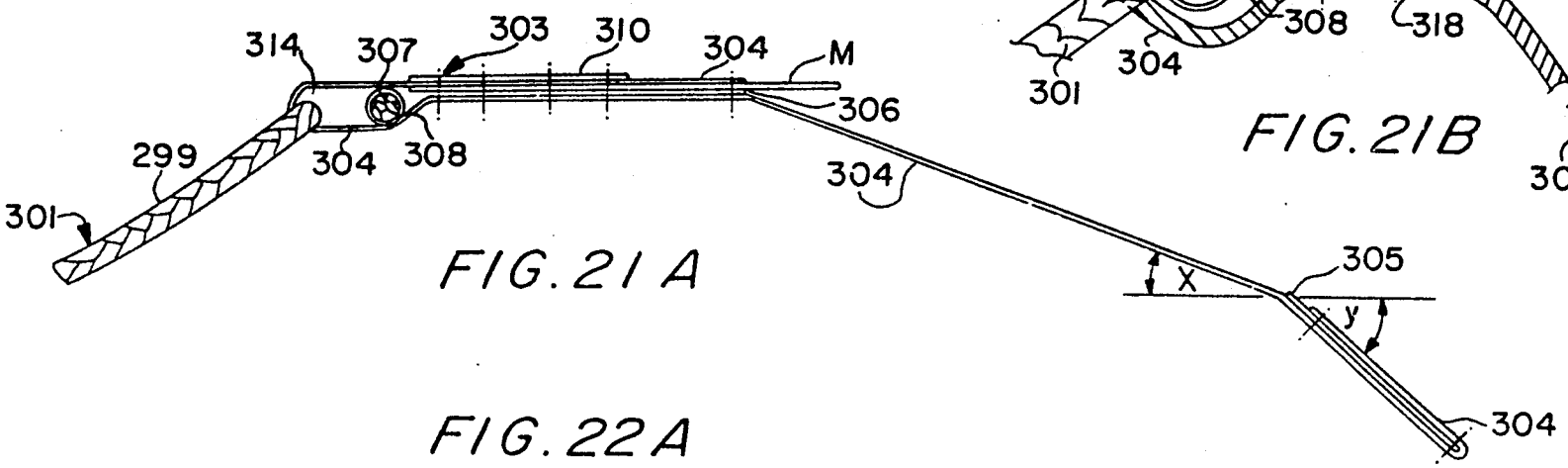
FIG. 21A shows a cross-sectional and cutaway view of the forward end of that which is shown in FIG. 18.

FIGS. 21A and 21B show in greater detail the forward end of aerial gunnery target 298. As shown, attachment members 304 extend at an incline from rearward connection means 305. The end portion of attachment members 304 are connected to rearward connection means 305 by extending the end portion about both sides of rearward connection means 305 and stitching the combination together. Rearward connection means 305 is positioned at an incline to confront in rushing air and to assist in inflating the forward end of the gunnery target.

The degree of incline is adjustable for intended use with the preferred incline being 40 degrees to 50 degrees as represented by angle "y" in FIG. 21A. As also shown in FIG. 21*a*, the preferred angle "x" for the incline of attachment members 304 is 15 degrees to 30 degrees.

As best shown in FIG. 21B first webbing member 310 is positioned externally of end portion 316 of attachment members 304. The visual augmenter netting M is positioned below end portion 316 while second webbing member 306 is positioned below mesh netting M. Body portion 318 of attachment members 304 are positioned directly below second webbing member 306 and the entire combination of body portion 318, second webbing member 306, mesh netting M, end portion 316 and first webbing member 310 are joined together preferably by box stitching, adhesive or a combination thereof.

In a preferred embodiment, first webbing member 310, second webbing member 306, attachment members 304, rearward connection means 305, bead 307 and thread 308 are all formed of a nylon material. The preferred dimensions include first webbing member having a two-inch width; rearward connection means having a width of 1 to 2 inches; second webbing member having a width of 3 inches; and attachment member having a width of 2 to 3 inches. Nylon thread 308 is preferably of 40 lb. strength.

Figure 22B:
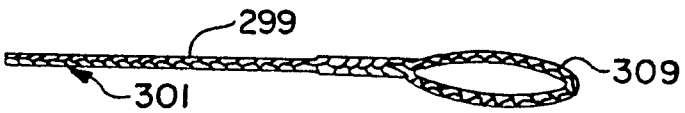
FIG. 22B shows the rearward, looped end of one of suspension lines shown in FIG. 22A.
Figure 22A:
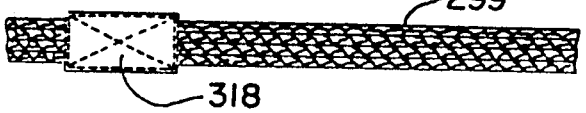
FIG. 22A shows in planar view the forwardmost end of the suspension line assembly shown in FIG. 18.

FIG. 22A shows the manner in which lines 299 are brought together at their end. As shown, wrap 318 is secured by a stitching process to the ends of four suspension lines doubled over to provide eight lines, extending outwardly. The suspension lines 299 are preferably formed of 3/16" diameter nylon rope (900 lbs).

FIG. 22B shows one of the suspension lines shown in FIG. 22A having a braided rope loop 309.

Figure 23B:
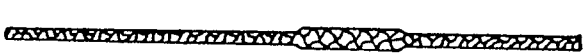
FIG. 23B shows a side view of that which is shown in FIG. 22B.
Figure 23A:
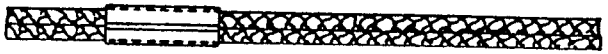
FIG. 23A shows in side view that which is shown in FIG. 22A.

FIG. 23A shows a side view of that which is shown in FIG. 22A. As shown the eight suspension lines are formed by doubling over four suspension lines and attaching web member 318 to hold the suspension lines together at a connection point. FIG. 23B shows a side view of the line shown in FIG. 23B.

Although the preferred embodiments of the present invention have been described with reference to the accompanying drawings, many modifications and changes may be effected by those skilled in the art without departing from the scope and spirit of the invention as appended hereinafter.

What is claimed is:

1. An aerial gunnery target, comprising:

suspension lines;

a vented inflator including forward connection means and rearward connection means longitudinally spaced from one another, said vented inflator further including attachment members extending between said forward and rearward connection means and said attachment members being spaced from one another, said attachment members being secured to said forward and rearward connection means and said attachment members each being attached to a respective one of said suspension lines, said forward and rearward connection means being essentially circular in configuration, and said forward connection means being larger in diameter than said rearward connection means such that said attachment members are at an incline in extending between said forward and rearward connection means; and a visual augmenter secured to said vented inflator.

2. An aerial gunnery target as recited in claim 1, wherein said visual augmenter is secured to said forward connection means.

3. An aerial gunnery target as recited in claim 1, wherein said visual augmenter is an essentially cylindrical mesh netting having an open forward and aft end.

4. An aerial gunnery target as recited in claim 1, wherein said forward connection means comprises a first webbing member having a circular configuration and a circular bead in attachment with said visual augmenter and spaced to one side of said first webbing means.

5. An aerial gunnery target as recited in claim 4, wherein said forward connection means further comprises a second webbing member having a circular configuration and spaced below said first webbing member, said visual augmenter positioned between said first and second webbing members and being attached to said first and second webbing members.

6. An aerial gunnery target as recited in claim 5, wherein said attachment members extend between said first and second webbing members and are affixed between said first and second webbing members, said attachment members being looped about said bead and affixed to the side of said second webbing member which is further from said first webbing member.

7. An aerial gunnery target as recited in claim 4, wherein said rearward connection means includes a strap member having a planar interior surface inclined such that in rushing air creates an outward tension in said circular strap member.

8. An aerial gunnery target as recited in claim 7, wherein said attachment members are flexible webs of material.

9. A visual augmenter system comprising:

a visual augmenter;

a vented inflator attached to said visual augmenter said vented inflator comprising a circular web and a circular webbing member longitudinally spaced from said circular web and having a diameter less than said circular web, a plurality of strap members having a first end, a body portion and a second end, said circular web attached to the body portion of said strap member, said strap member extending at an incline between said web and said webbing member, said webbing member attached to the second end of said strap member and the first end of said strap member including a loop section extending out away from said web and said webbing member.

* * * * *